US005653286A

United States Patent [19]

McCoy et al.

[11] Patent Number: 5,653,286

[45] Date of Patent: Aug. 5, 1997

[54] DOWNHOLE GAS SEPARATOR

[76] Inventors: James N. McCoy, 2210 Midwestern Pkwy., Wichita Falls, Tex. 76308; Augusto L. Podio, 204 Laurelwood Trail, Austin, Tex. 78746

[21] Appl. No.: 440,217

[22] Filed: May 12, 1995

[51] Int. Cl.[6] ..... E21B 43/00

[52] U.S. Cl. ..... 166/105.5

[58] Field of Search ..... 166/265, 105.5, 166/386, 68, 106

[56] References Cited

U.S. PATENT DOCUMENTS

| | | | |
|---|---|---|---|
| 1,548,802 | 8/1925 | Cotton | 166/105.5 X |
| 1,578,720 | 3/1926 | Derby | 166/105.5 |
| 2,429,043 | 10/1947 | Barnhart | 166/105.5 |
| 2,528,448 | 10/1950 | Munk | 166/105.5 |
| 2,748,719 | 6/1956 | Wells | 103/203 |
| 2,764,102 | 9/1956 | Abdo et al. | 166/105.5 |
| 2,843,053 | 7/1958 | Carle | 166/105.5 |
| 2,872,985 | 2/1959 | Bertuzzi et al. | 166/105.5 |
| 2,969,742 | 1/1961 | Arutunoff | 417/424.2 |
| 3,128,719 | 4/1964 | Jongbloed et al. | 103/203 |
| 3,887,342 | 6/1975 | Bunnelle | 166/105.5 X |
| 4,072,481 | 2/1978 | Laval, Jr. | 55/177 |
| 4,074,763 | 2/1978 | Stevens | 166/325 |
| 4,088,459 | 5/1978 | Tuzson | 166/105.5 X |
| 4,231,767 | 11/1980 | Acker | 166/105.5 X |
| 4,241,788 | 12/1980 | Brennan | 166/105.5 |
| 4,366,861 | 1/1983 | Milam | 166/105.5 |
| 4,481,020 | 11/1984 | Lee et al. | 166/105.5 X |
| 4,531,584 | 7/1985 | Ward | 166/265 |
| 4,624,310 | 11/1986 | Echols et al. | 166/105.5 X |
| 4,676,308 | 6/1987 | Chow et al. | 166/369 |
| 5,154,588 | 10/1992 | Freet et al. | 417/423.3 |
| 5,271,725 | 12/1993 | Freet et al. | 417/423.3 |

*Primary Examiner*—Roger J. Schoeppel
*Attorney, Agent, or Firm*—Sidley & Austin

[57] ABSTRACT

A downhole gas separator is connected to the lower end of a tubing string. The separator includes a tubular body which has a decentralizer mounted to one side for driving the opposite side of the separator against an interior wall of the casing. This creates a narrow flow zone between the separator body and the adjacent casing wall and a wider flow zone on the decentralizer side of the body. A fluid inlet is provided on the side of the gas separator tubular body facing the narrow flow zone. The fluid in the narrow flow zone has a substantially higher concentration of liquid than the fluid in the wider flow zone. Fluid, primarily liquid, flows through the fluid inlet into a chamber within the separator. A dip tube transfers the fluid from the separator chamber to the pump.

9 Claims, 3 Drawing Sheets

DOWNHOLE GAS SEPARATOR

BACKGROUND OF THE INVENTION

During the initial production of petroleum from a subterranean oil formation, the downhole pressure alone may be sufficient to force the well fluid upwardly through the well tubing string to the surface of the well bore. As long as the reservoir pressure is high enough, oil and gas are pushed to a wellbore from which they can be recovered. However, as fluids are removed from the reservoir, the pressure decreases. Once the downhole pressure is dissipated below a minimum level, some form of artificial lift is required to elevate the well fluid in the well bore.

A downhole rod pump is the most common form of artificial lift being used today. Typically, the downhole rod pump is suspended within a tubing string and operably connected to a reciprocating surface unit by a string of sucker rods. The sucker rods extend from the surface downhole to the production zone near the end of production tubing. The sucker rod pump is mounted near the end of the production tubing. The pump is driven by the sucker rod which extends to the surface and is connected to a polished rod. The polished rod reciprocates the rod pump to ultimately cause well fluid to exit at the surface.

Typically, the sucker rod pump is a two-cycle pump. During the upstroke, fluid is lifted upward through the tubing and, during the downstroke, the traveling valve and piston is returned to the bottom of the stroke. Subsurface pumps, such as the sucker rod pumps, are designed to pump incompressible liquid. However, petroleum is frequently a mixture of hydrocarbons that can take the form of natural gas and liquid crude oil. The presence of gas in the pump decreases the volume of oil transported to the surface because the gas takes space that could be occupied by liquid. Thus, the presence of gas decreases the overall efficiency of the pumping unit and reduces oil production. In addition, in wells which produce gas along with oil, there is a tendency for the gas to flow into the pump, which may result in a "gas lock" in the pump whereby no fluid is pumped or elevated in the well bore even though the surface unit is continuing to reciprocate. In the down-stroke of a gas-locked pump, pressure inside a barrel completely filled with gas may never reach the pressure needed to open the traveling valve, and whatever fluid or gas was in the pump barrel never leaves it. However, on the upstroke, the pressure inside the barrel never decreases enough for the standing valve to open and allow the fluid to enter the pump. Thus, for stroke after stroke, no liquid enters or leaves the pump, resulting in a gas-locked condition.

Frequently, a gas locked condition can be avoided by lowering the traveling valve so that a higher compression ratio is obtained in the pump. Lowering the traveling valve to a position close to the standing valve at the bottom of the downstroke will tend to force pump action more often because the traveling valve will open when the traveling valve "hits" the liquid in the pump or when the gas in the pump is compressed to a pressure greater than the pressure above the traveling valve. Lowering the traveling valve near the standing valve does not improve the gas separator efficiency however. If the gas separator does not efficiently separate gas from the liquid that enters the pump, the pump will still perform inefficiently regardless of the traveling valve/standing valve spacing.

In order to prevent entrained gas from interfering with the pumping of the oil, various downhole gas separators have been developed to remove the gas from the well fluid prior to the introduction of the fluid into the pump. For instance, U.S. Pat. No. 3,887,342 to Bunnelle, issued Jun. 3, 1975, and U.S. Pat. No. 4,088,459 to Tuzson, issued May 9, 1978, disclose centrifugal-type liquid-gas separators. U.S. Pat. No. 2,969,742 to Arutunoff, issued Jan. 31, 1961, discloses a reverse flow-type liquid-gas separator. U.S. Pat. No. 4,231,767 to Acker, issued Nov. 4, 1980, discloses a screen-type liquid-gas separator. U.S. Pat. No. 4,481,020 to Lee et al., issued Nov. 6, 1984, discloses a screw type inducer for pressuring and separating a liquid-gas fluid mixture.

Sometimes the pump is located below the producing interval and the natural separation of gas and liquid occurs. Other times, the pump is located in or above the producing interval where gas separation is much more difficult. This gas separator is designed for applications where the pump is located in or above the fluid entry zone.

When a pump inlet is placed above or in the formation gas entry zone, a gas separator with a gas anchor should be used below the pump in order to separate the gas from the liquid in an attempt to fill the pump with liquid instead of gas. With respect to gas anchors, U.S. Pat. No. 4,074,763 discloses a tool to be mounted near the end of the production string that uses a series of concentric conduits for separating gas out of the oil/gas mixture. U.S. Pat. No. 4,366,861 separates an oil/gas mixture by reversing the production fluid flow to liberate free gas.

SUMMARY OF THE INVENTION

The selected embodiment of the present invention is a downhole apparatus for separating gas from liquid. The apparatus comprises an elongate vessel which has a sidewall and an interior chamber. The vessel is closed at one end. The fluid inlet extends through the sidewall of the vessel. The opening area of the fluid inlet has a centroid which is at a first angular position about the axis of the vessel. A deflector is mounted to the vessel and extends outward from a second angular position about the axis of the vessel. The second angular position is angularly offset about the axis of the vessel from the first angular position.

In a further aspect of the present invention, a dip tube extends through the open end of the elongate vessel and has an opening for receiving fluid below the fluid inlet to the vessel.

In a further aspect of the present invention, the elongate vessel is provided with a gas vent which is above the fluid inlet and serves to release gas from the interior chamber.

In a still further aspect of the present invention, there is provided a second chamber below the interior chamber of the vessel. The second chamber is open at the lower end and has an opening through the sidewall of the vessel for releasing gas which collects in the second chamber.

DESCRIPTION OF THE DRAWINGS

For a more complete understanding of the present invention and the advantages thereof, reference is now made to the following description taken in conjunction with the accompanying drawings in which.

DETAILED DESCRIPTION

The present invention is a gas separator which in operation is positioned downhole in an oil well having a pump. The production fluid comprises gas and liquid, and it is highly desirable to separate the gas from the liquid so that the liquid can be pumped to the surface. The gas separator of the present invention is an apparatus which enhances the separation of gas from liquid so that the production of fluid from the well can be increased.

Figure 1:
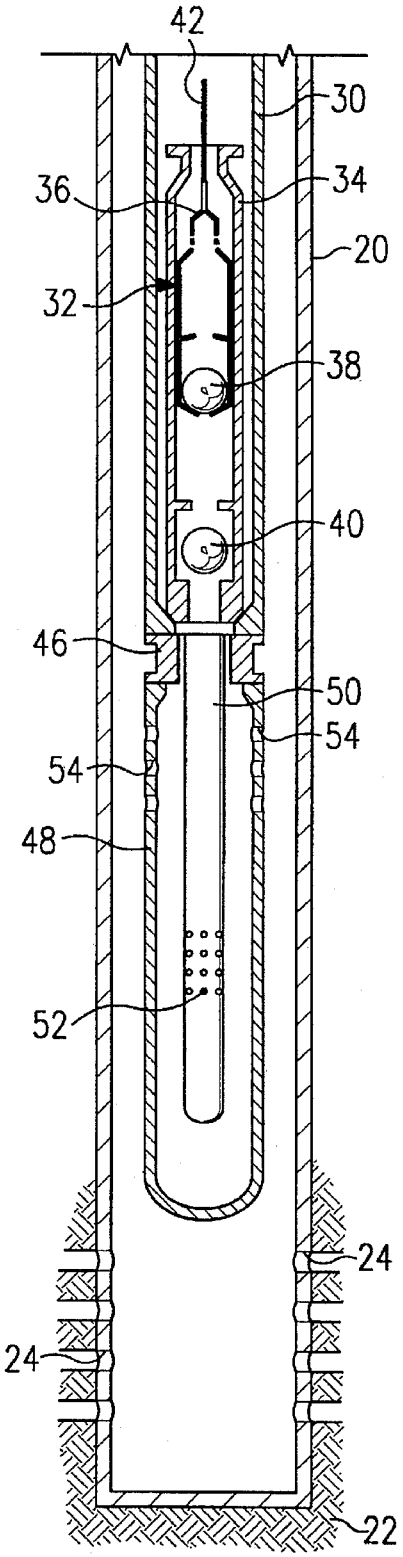
FIG. 1 (PRIOR ART)
FIG. 1 is an elevation, section view of a prior art downhole gas separator.

A prior art gas separator, shown in conjunction with a downhole pump is illustrated in FIG. 1. Casing 20 extends down into a borehole and is fixed in place by cement 22. The casing 20 has a plurality of formation perforations 24 which permit fluid from the surrounding formation to flow into the casing 20. A tubing string 30 is positioned within the casing 20. A pump 32 is mounted in the lowest joint of the tubing string 30. The pump 32 is a conventional design which includes a barrel 34 and a piston 36 which includes a traveling valve 38. The pump 32 further includes a standing valve 40. A sucker rod 42 reciprocates the piston 36 to lift liquid upward through the tubing string 30 to the surface.

A seating nipple 46 connects the lower end of the tubing string 30 to a prior art gas separator 48. A dip tube 50 extends from the lower end of the pump 32 downward into the gas separator 48. The dip tube 50 is provided with a plurality of holes 52.

The gas separator 48 has holes 54 at the upper end thereof. These holes are spaced periodically around the separator 48 and uniformly along an upper end of the separator. The production fluid, which comprises gas and liquid, passes through these holes.

In operation, the production fluid flows from a formation through the casing perforations 24 into the casing 20. As the fluid rises in the casing 20, it reaches the holes 54 where the fluid, which includes both gas and liquid, moves into the gas separator 48. The interior of the separator 48 comprises a quieting chamber in which a part of the gas bubbles separate out of the fluid and exits through the holes 54 into the annulus region between the tubing 30 and the casing 20. The fluid within the separator 48, which is primarily liquid, is drawn through the pick-up holes 52, up the dip tube 50, and lifted by the pump 32 through the tubing string 30 to the surface.

The gas separator 48 often does not provide a sufficient rate of separation to provide a steady flow of liquid through the dip tube 50 to the pump 32. As a result, gas is transferred along with the liquid through the dip tube 50 into the pump 32. The presence of gas within the pump 32 seriously reduces the effectiveness and efficiency of the pump operation.

The pump shown in FIG. 1 is a bottom hold-down pump. That is, the seal between the pump and the seating nipple is at the bottom of the pump. Top hold-down pumps seal between the top of the pump and the seating nipple. In this case, the pump could be ten to fifteen feet long and extend below the fluid inlet. A separate dip tube would not be needed.

Figure 2:
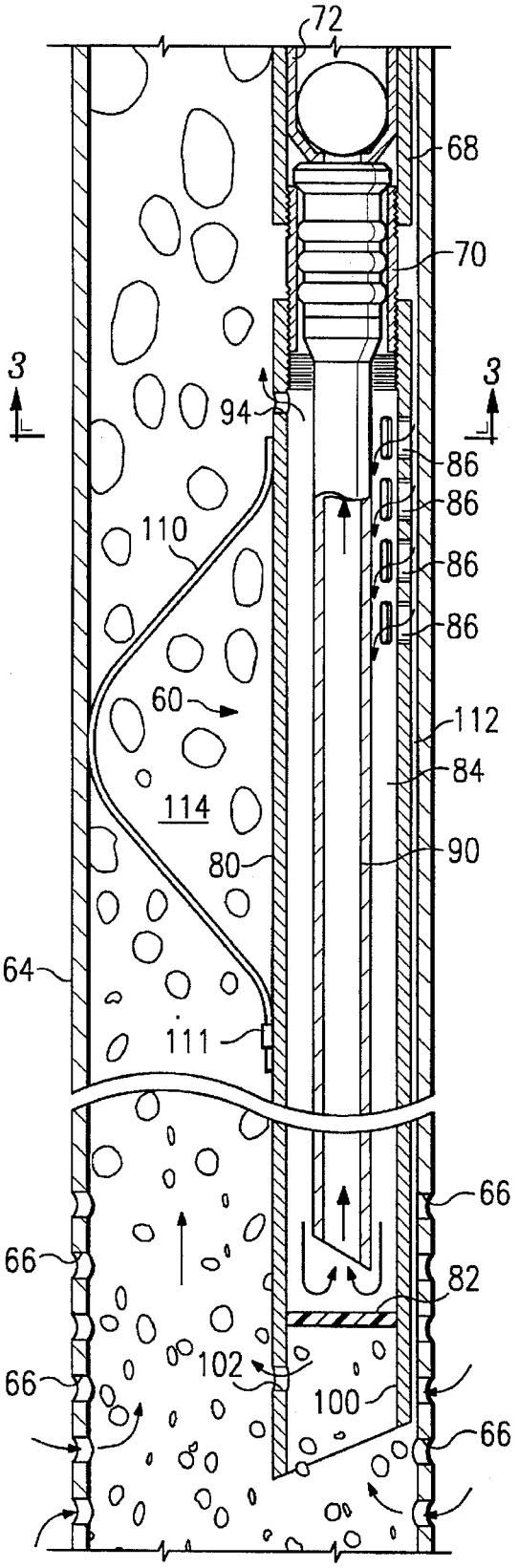
FIG. 2 is a section view of a downhole gas separator in accordance with the present invention.

A downhole gas separator 60 in accordance with the present invention is illustrated in FIG. 2. The gas separator 60 is positioned within a casing 64 which has a plurality of casing perforations 66. A tubing section 68 is connected to a seating nipple 70. A pump 72 is mounted within the tubing segment 68.

The gas separator 60 includes a tubular body 80. A plug 82 is mounted within the body 80 to define an interior chamber 84 within the gas separator 60. The body 80 comprises a cylindrical sidewall for the gas separator 60. The body 80 is threaded to the lower end of the seating nipple 70.

Fluid inlets 86, which extend through the sidewall of body 80, provide openings to permit fluid flow from the casing annulus into the interior chamber 84. There are eight inlets 86 shown for the gas separator 60. A dip tube 90 is threaded to the bottom of the pump 72. The dip tube 90 extends downward to near the bottom of the chamber 84. The bottom of the dip tube 90 is open for receiving liquid which is within the chamber 84.

At the upper end of the chamber 84, a gas vent hole 94 permits gas to escape from the chamber 84.

At the lower end of the tubular body 80, there is provided a lower chamber 100 which comprises an extension of the tubular body 80 on the lower side of the plug 82. A gas vent hole 102 permits gas which has been trapped in the chamber 100 to vent into the annulus between the separator 60 and the casing 64. The lower chamber 100 captures a part of the rising fluid and holds the fluid for a time to allow some of the gas within the fluid to separate and exit chamber 100 through the vent hole 102. The lower end of the chamber 102 has the tubular body cut at an angle so that shorter end, which is the higher end, is on the same side as the fluid inlets 86. The longer (lower) portion of the sidewall for chamber 100 is on the opposite side from the fluid inlets 86. The chamber 100 provides additional separation of gas from liquid. As fluid rises into chamber 100, the gas bubbles coalesce and vent through hole 102, while fluid with a lesser gas concentration leaves the chamber 100. A substantial portion of this fluid goes into a region 112.

The gas separator 60 is provided with a deflector 110, which is also referred to as a decentralizer. The deflector 110 comprises a segment of spring steel which is welded at an upper end to the body 80 and has the lower end inserted into a slot formed by a U-shaped member 111 welded on the outer surface of the body 80. The deflector 110 is mounted opposite from the fluid inlets 86. The deflector 110 has sufficient flexibility to permit the gas separator 60 to be installed down through the casing 64 without binding. The deflector 110 functions to drive the body portion of the gas separator 60 against an interior wall of the casing 64. Since the interior diameter of the casing 64 is greater than the exterior diameter of the body 80, there is not an area contact between the body and casing but only a line of contact. There is generally formed the narrow flow region 112 between the body 80 of gas separator 60 and the facing (closest) interior wall of the casing 64. On the other side of the body 80 there is formed a wider flow region 114 in which the deflector 110 is located. It has been found that the production fluid in the region 112, the narrow region, has a higher concentration of liquid than the fluid present in the wide flow region 114. This is illustrated in the section view shown in FIG. 3. Liquid 120 is represented by dashed lines and gas 122 is represented by the dotted area. The liquid 120 tends to collect in the region 112 and flow from the casing annulus through the fluid inlets 86 into the body 80 as indicated by the curved arrows. The liquid 120 of the production fluid tends to collect on the exposed surfaces of the casing and gas separator while the gas 122 tends to collect in the larger, more open region 114. By use of the gas separator 60 configuration shown in FIGS. 2 and 3, there is a substantially improved separation of gas from liquid as compared to the prior art gas separator shown in FIG. 1.

Figure 3:
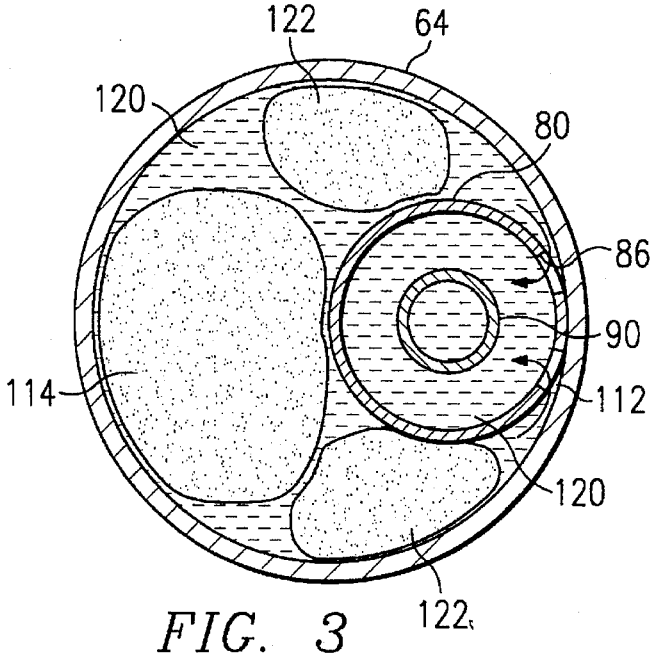
FIG. 3 is a section view taken along lines 3—3 in FIG. 2 and illustrates the distribution of gas and liquid within the well casing and the flow of liquid into the gas separator.

Further referring to FIG. 3, the fluid inlets 86 face the narrow region 112 so that predominately liquid 120 enters into the chamber 84 instead of the gas 122. Since some gas will enter into the chamber 84 through the fluid inlets 86, and other gas will bubble from the fluid collected within the chamber 84, there is provided the gas vent hole 94 at the top of the chamber 84. At least a portion of the gas which collects within the chamber 84 vents through the hole 94 into the wide flow region 114.

Figure 4:
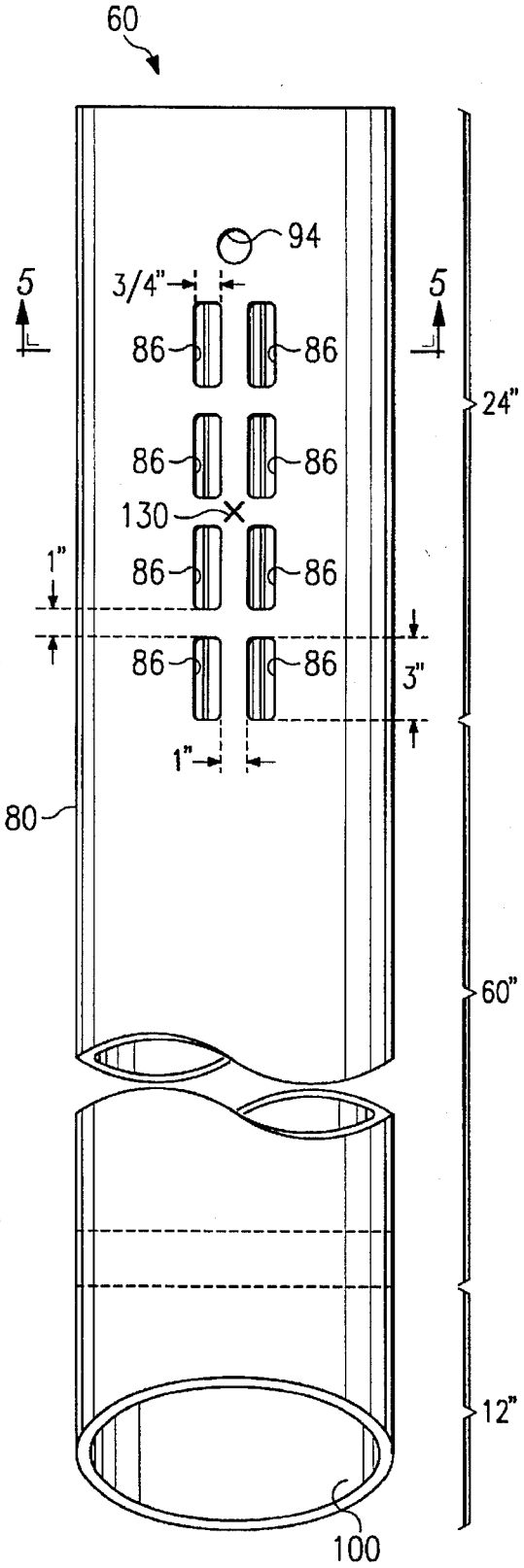
FIG. 4 is an elevation view of the gas separator shown in FIG. 2 facing the fluid inlet and illustrating the centroid of the area of the fluid inlet.

Referring now to FIG. 4, there is shown an elevation view of the gas separator 60. The fluid inlets 86 are generally located in a segment of the tubular body 80, which is approximately two feet long at the upper end. The lower end of the body 80 is approximately five feet long. The chamber 100 has a length of approximately nine inches. The body 80, in this embodiment, has a diameter of three inches. It has internal threads at the top end thereof for securing the separator 60 to a seating nipple 70, shown in FIG. 2, which is in turn threaded to a tubing segment 68 that contains the pump 72. Each of the fluid inlets 86, as shown in FIG. 4, has a generally rectangular shape with a length of three inches and a width of three-quarters of an inch. The fluid inlets 86 are arranged in an array comprising two columns and four rows. In each linear column of fluid inlets, the inlets are separated by a distance of approximately one inch. The two columns of fluid inlets are separated by approximately one inch.

A centroid 130 of the area of the fluid inlets is marked by a "x". The centroid is the geometric center of the opening area of the inlets 86. The centroid of this area may or may not be located within an actual opening for a fluid inlet.

Figure 5:
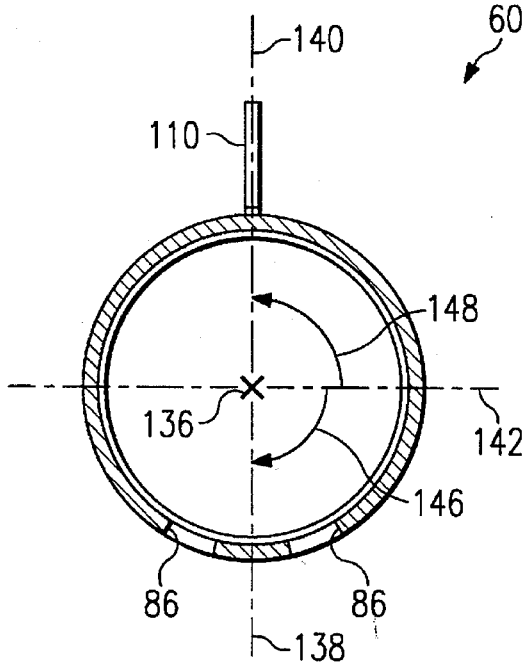
FIG. 5 is a section view taken of the gas separator shown in FIG. 2 and illustrating the angular relationship between the fluid inlet and the decentralizer.

Referring now to FIG. 5, there is shown a section view taken along lines 5—5 of the gas separator 60 shown in FIG. 4. The center axis 136 of the gas separator 60 is marked with an "x". A line 138 extends from the center axis 136 of the gas separator 60 through a plane that includes the centroid 130 of the fluid inlets 86. A line 140 extends from the center axis indicated by reference numeral 136 outward through the center of the deflector 110. For the embodiment of the gas separator 60 shown in FIGS. 2, 4 and 5, the centroid of the area of the fluid inlets 86 is located 180° (angular offset) away from the center of the defector 110. As illustrated in FIG. 5, the lines 138 and 140 are coplanar.

Further referring to FIG. 5, there is shown an arbitrary reference line 142 which passes through the center axis 136 of the gas separator 60. A curved arrow represents an angle 146 between line 142 and line 138. As shown in FIG. 5, angle 146 is +90°. A curved arrow representing an angle 148 is the angle between line 142 and line 140. As shown in FIG. 5, this is an angle of −90°. The angle 146 is defined as a first angular position about the center axis 136 of the gas separator 60, and the angle 148 is defined as a second angular position about the center axis 136 of the separator 160. The angle offset about the axis 136 between the centroid 130, indicated by line 138, and the deflector 110, indicated by the line 140, is 180°. While an angular offset of 180° is shown for the embodiment in FIG. 5, the present gas separator invention is not limited to this particular angular offset.

Figure 6:
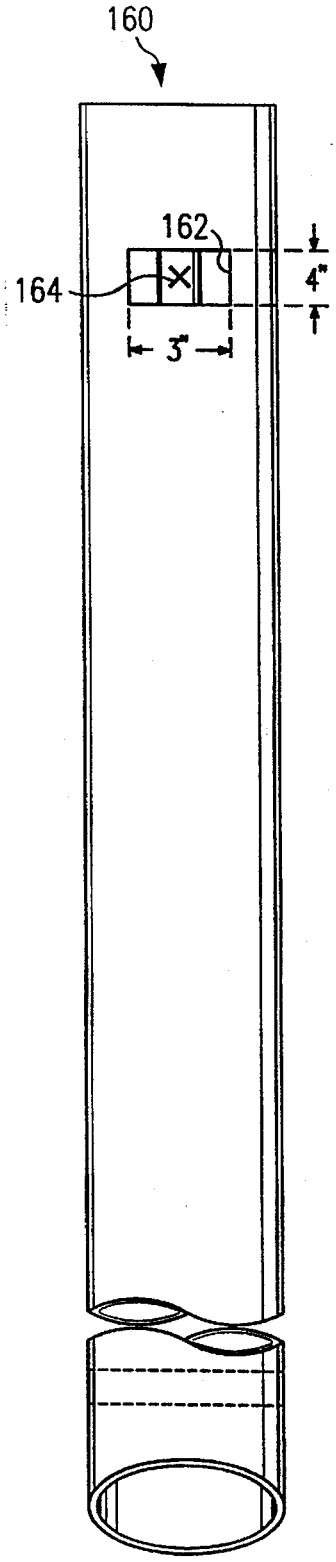
FIG. 6 is an elevation view of a gas separator in accordance with the present invention wherein the fluid inlet comprises a single port and the centroid of the port is illustrated.

Referring now to FIG. 6, there is shown a further embodiment comprising a gas separator 160 which has a fluid inlet 162 which comprises a single opening. The fluid inlet 162 has a centroid 164 which is located in the geometrical center of the opening.

Figure 7:
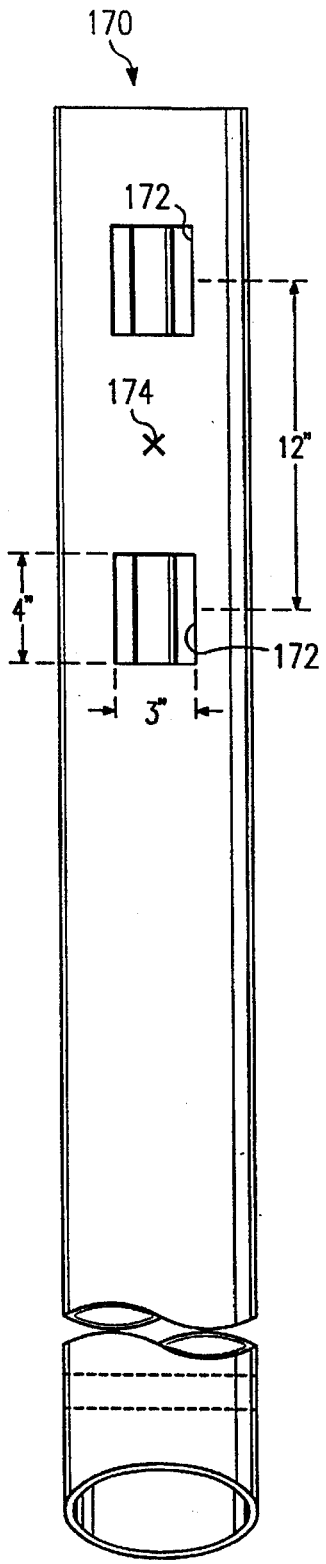
FIG. 7 is an elevation view of a further embodiment of the gas separator in accordance with the present invention within the fluid inlet port comprises two openings and the centroid of the port is shown.

Referring now to FIG. 7, there is shown a further embodiment comprising a gas separator 170 which has fluid inlets 172 that have a centroid 174 for the opening area. Each of the fluid inlets 172 is a rectangle having a length of four inches and a width of three inches. The center to center spacing of the inlets 172 is approximately one foot.

Figure 8:
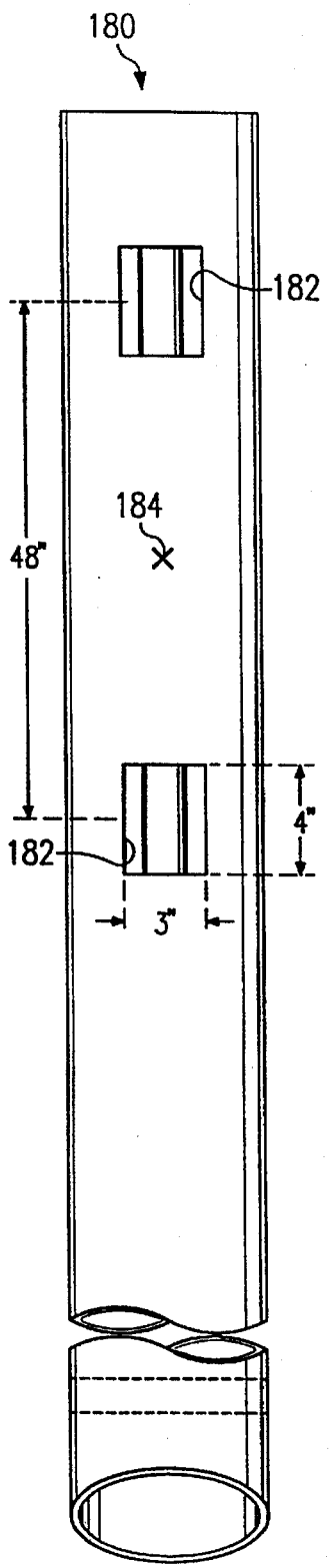
FIG. 8 is an elevation view of a further embodiment of the gas separator in accordance with the present invention within the fluid inlet port comprises two openings and the centroid of the port is shown.

A still further embodiment is a gas separator 180 shown in FIG. 8. Gas separator 180 has fluid inlets 182 which have an area centroid 184. Each of the fluid inlets 182 is approximately four inches long and three inches wide. The center to center spacing of the fluid inlets 182 is approximately four feet.

A single deflector is shown in each of the above embodiments. However, multiple deflectors may be connected to the gas separator to drive the side of the separator body having the fluid inlet against the interior wall of the casing. For example, two spring deflectors may be mounted at +120° and −120° angular offsets from the centroid of the fluid inlet opening. Other possible deflector configurations include one or more flexible members extending perpendicularly to the axis of the separator. The deflector(s) can be in any configuration to drive the body of the gas separator against the interior wall of the casing.

Although several embodiments of the invention have been illustrated in the accompanying drawings and described in the foregoing detailed description, it will be understood that the invention is not limited to the embodiment disclosed, but is capable of numerous rearrangements, modifications and substitutions of parts and elements without departing from the spirit of the invention.

What we claim is:

1. A downhole apparatus for separating gas from liquid in a borehole which has casing and a tubing string installed therein and a pump is mounted to the tubing string, the apparatus comprising:

a tubular body for connection to the lower end of said tubing string, said tubular body having a seal and a chamber above the seal, a decentralizer connected to said tubular body and extending outward therefrom wherein the combined width of said tubular body and said decentralizer is equal to or greater than the interior diameter of said casing, and a fluid inlet passing through the sidewall of said tubular body and open to said chamber, said fluid inlet port substantially angularly offset about the axis of said tubular body from said decentralizer.

2. A downhole apparatus for separating gas from liquid as recited in claim 1 including a gas vent hole which extends through said sidewall of said tubular body, said gas vent hole positioned on an opposite side of said body from said fluid inlet.

3. A downhole apparatus for separating gas from liquid as recited in claim 1 including wherein said decentralizer is a spring having first end connected to said tubular body.

4. A downhole apparatus for separating gas from liquid as recited in claim 1 wherein said fluid inlet is a single opening.

5. A downhole apparatus for separating gas from liquid as recited in claim 1 wherein said fluid inlet comprises a plurality of openings.

6. A downhole apparatus for separating gas from liquid as recited in claim 1 including a lower chamber of said tubular body, said lower chamber located below said seal, said lower chamber open at the lower end thereof and having a gas vent hole extending through the sidewall of said tubular body.

7. A downhole apparatus for separating gas from liquid as recited in claim 6 wherein the lower end of said lower chamber has a slanted opening with an upper portion on the same side of said body as said fluid inlet.

8. A downhole apparatus for separating gas from liquid as recited in claim 1 including a dip tube which is sealed at an upper end thereof to an upper end of said tubular body and extends downward through at least a portion of said chamber, said dip tube open at lower end thereof for receiving fluid from said chamber for transfer to said pump.

9. A downhole apparatus for separating gas from liquid as recited in claim 1 including a dip tube which is sealed at an upper end thereof to said pump and extends downward through at least a portion of said chamber, said dip tube open at a lower end thereof for receiving fluid from said chamber for transfer to said pump.

* * * * *